US006659384B2

(12) United States Patent
Milanese et al.

(10) Patent No.: US 6,659,384 B2
(45) Date of Patent: Dec. 9, 2003

(54) PRE-WOUND BOBBIN WITH MAGNETIZED FLANGE

(75) Inventors: Dennis A. Milanese, Hendersonville, NC (US); William C. Stuckey, Hendersonville, NC (US); Michael W. Moennig, Ooltewah, TN (US)

(73) Assignee: J. & P. Coats Limited, Glasgow (GB)

( * ) Notice: Subject to any disclaimer, the term of this patent is extended or adjusted under 35 U.S.C. 154(b) by 0 days.

(21) Appl. No.: 09/934,395

(22) Filed: Aug. 21, 2001

(65) Prior Publication Data

US 2003/0038208 A1 Feb. 27, 2003

(51) Int. Cl.[7] ..... B65H 77/00

(52) U.S. Cl. ..... 242/419.3; 242/610.4; 242/610.5; 242/615

(58) Field of Search ..... 242/419.3, 118.7, 242/610.4, 610.5, 614

(56) References Cited

U.S. PATENT DOCUMENTS

| | | | | |
|---|---|---|---|---|
| 2,543,475 A | | 2/1951 | Slodysko | |
| 2,561,155 A | | 7/1951 | Thomas, Jr. et al. | |
| 2,763,227 A | | 9/1956 | Howard | |
| 2,975,738 A | | 3/1961 | Hoppe | |
| 3,716,202 A | | 2/1973 | Thomas | |
| 3,991,692 A | * | 11/1976 | Papajewski et al. | 112/278 |
| 4,429,649 A | * | 2/1984 | Eguchi et al. | 112/229 |
| 4,793,273 A | * | 12/1988 | Hara et al. | 112/254 |
| 5,018,465 A | | 5/1991 | Hager et al. | |
| 5,152,236 A | | 10/1992 | Hirose | |
| 5,775,243 A | | 7/1998 | Kinoshita et al. | |
| 5,875,983 A | | 3/1999 | Stuckey et al. | |
| 6,112,684 A | * | 9/2000 | Papajewski | 112/185 |
| 6,257,512 B1 | * | 7/2001 | Schoeck et al. | 242/610.4 X |

FOREIGN PATENT DOCUMENTS

| | | |
|---|---|---|
| WO | WO 00/36201 | 6/2000 |

* cited by examiner

*Primary Examiner*—William A. Rivera
(74) *Attorney, Agent, or Firm*—Alston & Bird LLP

(57) ABSTRACT

A pre-wound bobbin for sewing, having a single flange or a pair of flanges, in which one flange of the bobbin comprises a magnetized material such that the flange magnetically adheres to the end wall of a steel bobbin case in which the bobbin is carried in a sewing machine. The flange is sized to provide a contact area with the end wall that, in relation to the magnetic strength of the magnetized material, achieves a magnetic attraction force exceeding the weight of the bobbin so that the bobbin is held in the bobbin case. The flange preferably is flexible.

26 Claims, 1 Drawing Sheet

PRE-WOUND BOBBIN WITH MAGNETIZED FLANGE

FIELD OF THE INVENTION

The present invention relates to bobbins for use in sewing machines, and relates more particularly to bobbins that are furnished with a quantity of sewing thread pre-wound thereon.

BACKGROUND OF THE INVENTION

In a typical lock-stitch sewing operation performed on an automatic sewing machine, a reciprocating needle carries a needle thread through a fabric from one side thereof through to the other side of the fabric, and the needle thread is looped around an under thread fed from a bobbin, such that the needle thread and the under thread form interlocking loops. The bobbin comprises a spool of thread rotatably mounted in a bobbin case located beneath the foot plate of the sewing machine over which the fabric travels.

A typical bobbin case 10 is shown in FIG. 1, along with a conventional single-flange bobbin 20. The bobbin case comprises a cup-shaped housing formed of steel. A post 12 is mounted on an end wall 14 of the bobbin case and the bobbin 20 has a hollow cylindrical core 22 that fits over the post loosely enough so that the bobbin can freely rotate on the post. The bobbin thread 24 or under thread is wound about the core. A lock-stitch sewing machine includes mechanisms for guiding the bobbin thread out from the bobbin case and looping it in interlocking relation with the needle thread. During continuous lock stitching, the bobbin 20 rotates in the bobbin case 10 as a result of the bobbin thread being drawn out from the bobbin case by the various mechanisms.

When the sewing machine operator stops the machine, the various mechanisms of the machine tend to stop abruptly so that the tension on the bobbin thread suddenly ceases, but there is a tendency for the bobbin to continue to rotate in the bobbin case until frictional forces between the bobbin and the case bring the bobbin to a halt. This phenomenon is generally known as overspin. When the bobbin overspins, slack is created in the bobbin thread, and if the overspin is great enough, the slack thread can become looped around components in the bobbin case in an undesirable fashion, resulting in breakage of the thread when sewing is recommenced. Thus, it is desirable to minimize overspin as much as possible.

The draw-off tension, or amount of force required to draw the bobbin thread out from the bobbin case, is also an important parameter affecting the quality of stitching performed on lock stitch sewing machines. Bobbin assemblies typically include a tension adjustment spring for adjusting this draw-off tension to a desirable level for the particular type of bobbin thread being used and the sewing operation being performed. A typical amount of draw-off tension is about 30 to 35 grams. Although the tension adjustment spring can affect the average level of the draw-off tension, the draw-off tension can also be affected by interaction between the bobbin and the bobbin case. For example, in the case of bobbins of the type generally referred to as sidewall bobbins, having a circular sidewall or flange 26 attached to one or to each end of the core 22 such as in the single-flange bobbin 20 shown in FIG. 1, the outer periphery of the flange(s) 26 can rub against the inner surface of the bobbin case.

Such interference between the flange(s) 26 and the bobbin case is a potential problem particularly in sewing machines that employ automated bobbin changing devices, which automatically remove the bobbin case from the sewing machine when the bobbin thread is depleted and replace the bobbin case with another bobbin case containing a fully wound bobbin. During the automatic changing operation, the bobbin case can be subject to forces and accelerations that can tend to dislodge the bobbin from the case. To retain the bobbin in the case, conventional bobbin cases include a lever arm 16 pivotally mounted on the end wall of the bobbin case and connected with a movable finger 18 that can project through an opening in the side wall of the bobbin case and engage the flange of the bobbin contained therein, as shown in solid lines in FIG. 2. The automatic bobbin changing apparatus A, schematically depicted in FIG. 2, is operable to actuate the lever arm 16 to cause the movable finger 18 to move into position engaging the flange 26 of the bobbin during the bobbin changing procedure. Once the bobbin case is installed in the sewing machine, the lever arm 16 is released so the finger 18 disengages the flange to allow the bobbin to rotate freely, as shown in phantom lines in FIG. 2.

In order for the finger to be able to properly engage the flange 26, the outer diameter of the flange must be only very slightly smaller than the inner diameter of the bobbin case. For instance, in prior single-flange bobbins made by the assignee of the present application, the flange has a nominal outer diameter of 0.865 inch, whereas the bobbin cases in which the bobbins are used have a nominal inner diameter of about 0.875 inch. Accordingly, if the flange 26 is mounted slightly eccentrically relative to the core 22 of the bobbin as a result of normal manufacturing tolerances during manufacture of the bobbin, the flange can rub against the inner surface of the bobbin case. This can cause the draw-off tension of the bobbin to be higher than optimal, and to vary to an undesirable extent.

Ideally, the draw-off tension should be constant and should be in an optimal range for the particular stitching operation being performed. Eliminating the flange(s) of the bobbin to create a so-called sideless bobbin would circumvent the problem of interference between the flange(s) and the bobbin case, but then another way of retaining the bobbin in the bobbin case during an automatic changing operation would have to be provided. Published International PCT Application WO 00/36201 describes a sideless bobbin that purports to solve this problem. The sideless bobbin comprises a hollow cylindrical core that is magnetized so that it is magnetically attracted to the steel post and end wall of the bobbin case, thus retaining the bobbin in the bobbin case during an automatic changing procedure. The sideless bobbin of WO 00/36201 is also said to reduce overspin of the bobbin and to improve the uniformity of draw-off tension as a result of the magnetic attraction force between the core and the bobbin case post and end wall.

It is believed the sideless bobbin in accordance with WO 00/36201 would have a number of drawbacks in practice. Because there must be a radial clearance between the core and the bobbin case post, the contact area between the inner surface of the core and the post must be quite small. More importantly, the contact between the core and the post can vary significantly and can even momentarily cease altogether as a result of wobbling or lateral movement of the bobbin on the post as the bobbin rotates, in which case the magnetic drag force between the bobbin and the post could momentarily drop to zero or a very low value, then jump up to a higher value when contact between the core and the post resumes. It is expected that this phenomenon would result in non-uniform draw-off tension.

A further drawback of the sideless bobbin of WO 00/36201 is that the magnetized core is magnetically attracted not only to the bobbin case, but also to the bobbin basket in which the bobbin case is installed in a sewing machine (for example, see the bobbin basket B schematically depicted in FIG. 2). Thus, as stated in WO 00/36201, it is important to assure that the magnetic attraction force between the magnetized core and the bobbin case is greater than that between the magnetized core and the bobbin basket, so that the bobbin will be extracted along with the bobbin case during a bobbin changing procedure. Accordingly, use of the sideless bobbin necessitates special accommodations to assure that this is the case. In the case where the magnetized core has uniform magnetic strength over its entire length (which is the simplest form of the core to manufacture), the patent application suggests that a gap must be created between the core and the base of the bobbin basket. This gap can be created by placing a non-ferrous washer in the bobbin basket, or by coating the bobbin basket with a non-ferrous material. It would be desirable, however, not to have to make such alterations in the conventional bobbin basket arrangement.

Thus, it is apparent based on the foregoing and the prior art that a long-standing problem has existed in sewing machine bobbin arrangements with respect to attaining a desired uniform draw-off tension and reducing overspin with pre-wound bobbins that are capable of being used in systems employing automated bobbin changing mechanisms. The problem existed as of the date of the invention described in the publication WO 00/36201, and continues to exist, but the purported solution proposed in that publication is not entirely satisfactory as noted above.

SUMMARY OF THE INVENTION

The present invention addresses the above needs and achieves other advantages, by providing a pre-wound bobbin of the sidewall type having a single flange or a pair of flanges, in which one flange of the bobbin comprises a magnetized material such that the flange magnetically adheres to the end wall of the bobbin case. The flange is sized to provide a contact area with the end wall that, in relation to the magnetic strength of the magnetized material, achieves a magnetic attraction force exceeding the weight of the bobbin so that the bobbin is held in the bobbin case against the force of gravity when the case is oriented with its open side facing downward, such as may occur during an automatic bobbin change.

Preferably, the magnetic attraction force is such that the draw-off tension due solely to the magnetized flange (i.e., not augmented by any tension adjustment spring or tack on the thread or the like) is less than about 30 grams, and more preferably less than about 20 grams. This enables the user to use a tension adjustment spring or the like to adjust the draw-off tension to be within a desirable range such as about 30–35 grams.

In accordance with a preferred embodiment of the invention, the flange is of such size in terms of surface area that contacts the end wall of the bobbin case, and the magnetized material is of such magnetic strength, that the magnetic attraction force between the flange and the end wall is about 10 to 20 times the weight of the pre-wound bobbin. In this way, the magnetic attraction force is sufficient to retain the bobbin in the bobbin case in opposition to inertial forces that may be imposed on the bobbin as a result of acceleration of the bobbin case during an automatic bobbin change.

The flange preferably is relatively flexible, which enables the flange to flex and conform to the end wall of the bobbin case so that it lies flat against the end wall. This means that surface imperfections, inaccuracies, or irregularities in the surface of the bobbin case end wall become less important in terms of affecting the draw-off tension. Preferably, the flange comprises a flexible sheet magnet formed of a flexible plastic or rubber type material impregnated with magnetized particles.

The magnetized material of the flange preferably adheres to a planar, bare steel surface with a magnetic attraction force of about 0.2 to 0.4 pounds (90 to 180 grams) per square inch of the material. The flange formed from this material preferably has a surface area of about 0.2 to 0.5 square inch. The magnetic attraction force preferably is about 25 to 60 grams for pre-wound bobbins weighing approximately 2.5 to 3 grams.

An advantage of the present invention is that the flange can be made significantly smaller than the inner diameter of the bobbin case; preferably, the flange outer diameter is equal to or less than the initial diameter of the roll of thread prior to usage of any of the thread. As a result, eccentric mounting of the flange on the core becomes less of a concern because the diameter of the flange can be made small enough in relation to the bobbin case to accommodate the largest expected eccentricity of the flange that may occur in manufacturing of the bobbin. Furthermore, if desired, the bobbins of the present invention can be used with bobbin cases that do not have fingers for engaging flanges, thus enabling the bobbin cases to be simplified.

In preferred embodiments of the invention, the core of the bobbin comprises a non-magnetic and non-magnetized material. Thus, the only magnetized component of the bobbin is the magnetized flange, which is remote from the bobbin basket in which the bobbin case and bobbin are installed in a sewing machine. Therefore, the magnetic attraction force between the bobbin and the bobbin basket is negligible, thereby increasing the likelihood that the bobbin case and bobbin will be extracted as a unit from the bobbin basket. Yet another advantage of the invention is that no additional components or coatings need to be provided in the bobbin basket for providing magnetic isolation between the bobbin and the bobbin basket. This is in contrast to the sideless bobbin of WO 00/36201, which requires a non-ferrous washer in the bobbin basket or a non-ferrous coating on the bobbin basket, at least with some embodiments of the sideless bobbin.

Bobbins in accordance with the present invention can be made as single-flange or double-flange bobbins. A single-flange bobbin has a flange mounted to one end of the core, but the opposite end of the core has no flange. A double-flange bobbin has a flange at each end of the core. Double-flange bobbins in accordance with the present invention preferably have a second flange that is non-magnetized and non-magnetic; advantageously, the second flange can be made of a flexible material such as paper, plastic, or the like. Making the bobbin in this way is advantageous not only because the second flange can be made less expensively than the magnetized flange, but also because the proper orientation of the bobbin (i.e., magnetized flange toward the end wall of the bobbin case) can be readily determined from a casual visual inspection of the bobbin, since the magnetized flange has a dramatically different appearance from the non-magnetized flange. This is in contrast to a sideless bobbin such as disclosed in the aforementioned WO 00/36201, whose proper orientation may be determinable only by carefully observing the direction (i.e., clockwise or counterclockwise) in which the thread is wound. Of course, the single-flange bobbins of the invention are also easy to properly orient in the bobbin cases.

The bobbins of the present invention are also advantageous because the contact area between the magnetized flange and the end wall of the bobbin case tends to be constant and thus the magnetic drag force on the bobbin tends to be constant, which leads to better uniformity in draw-off tension. Moreover, the contact area can be easily tailored to provide a desired amount of magnetic attraction force by changing the size of the flange. These advantages are in contrast to sideless bobbins such as disclosed in WO 00/36201, wherein the contact area between the magnetized core and the bobbin case post can vary significantly, particularly when the bobbin wobbles as sideless bobbins have a tendency to do, leading to varying magnetic drag and hence varying draw-off tension. Furthermore, the contact area between the sideless bobbin core and a given bobbin case cannot be altered to any significant extent and thus cannot be used as a design parameter for purposefully affecting magnetic drag, whereas the present invention allows the contact area to be varied to a substantial extent.

It is also believed that the bobbin of the present invention will have a reduced amount of overspin relative to the sideless bobbin of WO 00/36201, because the amount of contact area between the magnetized flange and the bobbin case end wall can be substantially greater than the contact area between the sideless bobbin core and the bobbin case post and end wall, thereby providing a greater amount of magnetic braking. Additionally, flanged bobbins in accordance with the invention are expected to have a reduced tendency to wobble in the bobbin case relative to sideless bobbins, by virtue of the substantial contact between the flange and the bobbin case end wall.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 3:
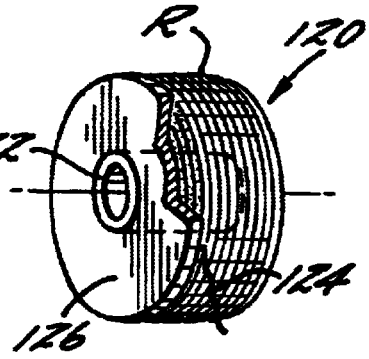
FIG. 3 is a perspective view, partly broken away, of a pre-wound bobbin in accordance with one embodiment of the present invention.
Figure 2:
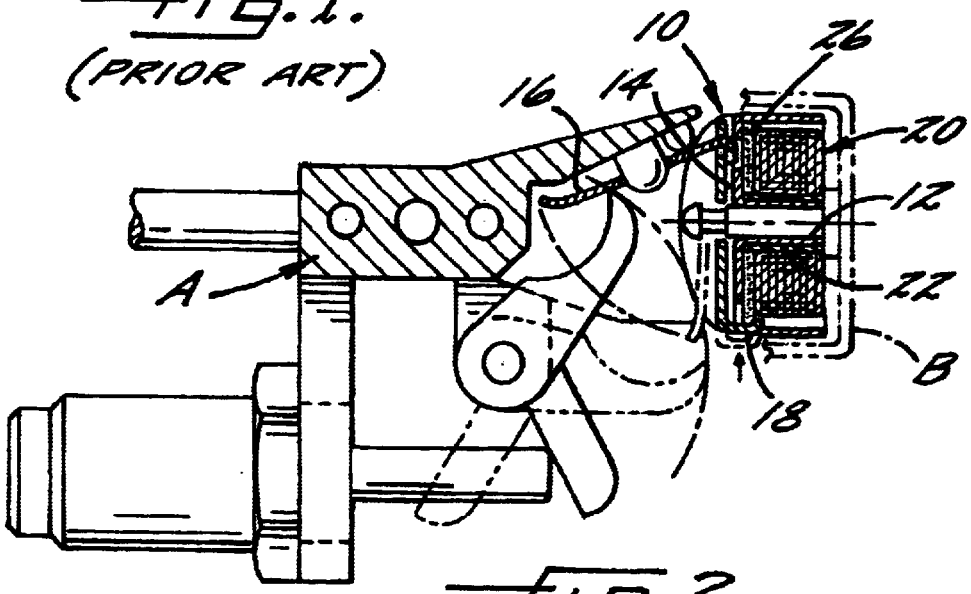
Fig. 2. (PRIOR ART)
FIG. 2 is a side elevation, partly in section, showing a bobbin changing device installing a bobbin case and bobbin into a bobbin basket, in accordance with prior art.
Figure 4:
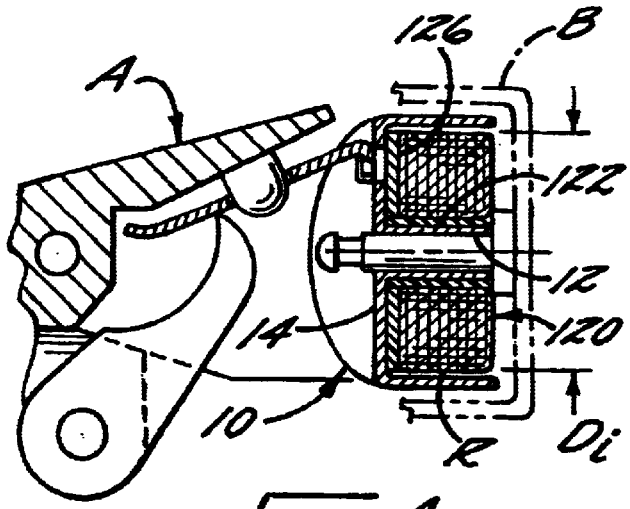
FIG. 4 is a view similar to FIG. 2, showing a bobbin case and bobbin in accordance with the invention being installed into a bobbin basket.

A pre-wound bobbin 120 in accordance with a first embodiment of the invention is depicted in FIGS. 3 and 4. The bobbin includes a hollow cylindrical core 122 onto which a continuous length of thread 124 is wound to form a roll R that has a substantially cylindrical shape. Preferably, the thread is adhered to itself by applying an adhesive substance to the thread prior to winding, or by otherwise tacking the thread being wound to underlying layers of thread previously wound, as known in the art, such that the roll of thread forms a substantially solid cylindrical body and the thread does not unwind of its own accord. The tack on the thread also tends to prevent the thread from continuing to unwind from the roll when the draw-off tension is discontinued.

A variety of materials can be used for forming the core 122, including but not limited to polymers (e.g., nylon, polyethylene, polypropylene, polycarbonate, polystyrene, etc.), paper, metal, and others. Preferably, the core is formed as a spirally wound paper tube. The core preferably is not magnetized so that it will not be attracted to the bobbin basket B in which the bobbin and bobbin case are received as shown in FIG. 4.

The bobbin 120 also includes a flange 126 of annular shape mounted on one end of the core 122. The flange 126 in the illustrated embodiment has a circular outer periphery, which is nominally concentric with the central longitudinal axis of the core 122. The flange 126 includes a magnetized material for exerting a magnetic attraction force on the end wall 14 of a bobbin case 10 when the bobbin is mounted therein such as shown in FIG. 4.

The magnetized flange 126 can be formed in various ways. For instance, the flange can comprise a rigid magnet, such as a ceramic magnet, rare earth magnet, alnico magnet, or the like. Preferably, however, the flange is flexible so that it can conform to the end wall of the bobbin case, and to any irregularities or imperfections therein, and thus lie flat against and make good, consistent contact with the end wall. Thus, the flange in preferred embodiments of the invention comprises a flexible magnet sheet that is cut to have the desired shape and size. A flexible magnet sheet in general comprises a sheet of flexible polymer material having magnetized particles embedded in or interspersed throughout. Various types of flexible magnetic sheeting having various magnetic strengths are known and commercially available.

In accordance with the present invention, the magnetic attraction force between the flange 126 and the bobbin case end wall 14 is tailored in magnitude so as to provide a desired level of magnetic drag resisting rotation of the bobbin in the bobbin case, and so as to reduce the tendency of the bobbin to overspin in the bobbin case when the draw-off tension on the thread is suddenly stopped. The term "magnetic drag" is used herein to denote the drag or torque on the bobbin due solely to the magnetic flange 126. It will be appreciated that the draw-off tension that must be exerted on the bobbin thread to unwind the thread from the bobbin during sewing is affected by this magnetic drag, but is also affected by other factors, including the tack on the thread and the action of the tension adjustment spring that is conventionally provided in the bobbin case/basket arrangement for adjusting the draw-off tension. Preferably, the magnetic drag alone gives rise to a draw-off tension that is less than the total draw-off tension that is desired during sewing. Thus, for example, if the normal draw-off tension desired for sewing is about 30–35 grams, the magnetic drag should give rise to a draw-off tension less than 30 grams. In this way, the tension adjustment spring can be used to adjust the tension to the desired level. Preferably, the magnetic drag should give rise to a draw-off tension less than about 20 grams.

In preferred pre-wound bobbins in accordance with the invention, the magnetized flange 126 is made of a magnetized material that produces a magnetic attraction force on the end wall of the bobbin case that exceeds the weight of the bobbin. More preferably, the magnetic attraction force is several times the weight of the bobbin. The magnetic attraction force thus is sufficient to retain the bobbin in the bobbin case during an automatic bobbin change even if the bobbin case should be turned with its open side downward and/or should be accelerated in such a way as to tend to sling the bobbin out from the bobbin case. In a preferred embodiment of the invention, the magnetic attraction force is about 10 to 20 times the weight of the bobbin.

The magnetic attraction force is a function of the magnetic strength of the magnetized material and the area of the flange in contact with the end wall of the bobbin case. Preferably, the magnetized material adheres against a bare, smooth, planar steel surface with a magnetic attraction force of about 0.2 to 0.4 pounds per square inch. The flange 126 preferably has a surface area of about 0.2 to 0.5 square inch.

The flange 126 can be a unitary structure or can be a laminated structure. For instance, the flange can be formed of a flexible magnet sheet laminated to a layer of non-magnetized material such as plastic on the outer surface of the flange that faces the roll of thread on the bobbin. The non-magnetized layer is advantageous because it lends additional tear-resistance to the flange. Where the flange 126 comprises a flexible magnet sheet laminated to a plastic layer, the flange preferably has a thickness of about 0.01 to 0.02 inch, more preferably about 0.012 to 0.015 inch.

Figure 1:
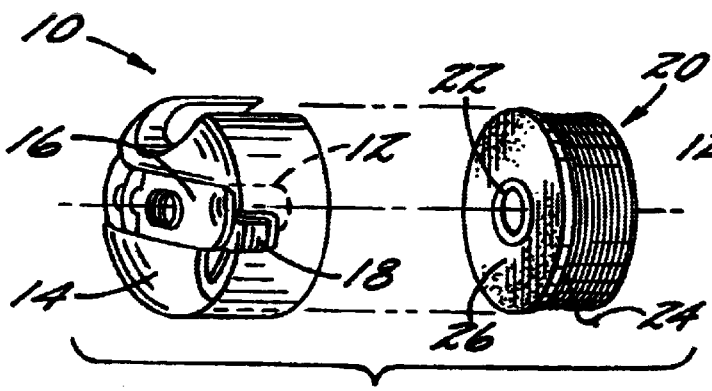
Fig. 1. (PRIOR ART)
FIG. 1 is an exploded perspective view of a bobbin case and bobbin in accordance with prior art.

As an illustrative example, a pre-wound bobbin in accordance with the invention has a flexible flange 126 having an outer diameter of about 0.770 inch, a surface area of about 0.4 square inch, and a thickness of 0.015 inch. The core 122 has an outer diameter of about 0.30 inch. The initial diameter $D_i$ (see FIG. 4) of the roll R of thread wound on the core 122 is about 0.85 inch. The bobbin is designed to be installed in bobbin cases having an inner diameter of about 0.875 inch. Thus, there is a significant radial clearance between the flange and the inner surface of the bobbin case, making it unlikely that the flange will contact the inner surface even if the flange is somewhat eccentric relative to the core. The flange is made of a magnet sheet having an nominal magnetic pull of about 40 pounds per square foot (0.2778 pounds per square inch), thus yielding a magnetic attraction force of about 0.11 pound (50 grams), assuming the full surface area of the flange lies flat against a steel surface. The bobbin has a weight of about 2.78 grams. Thus, the magnetic attraction force is about 18 times the weight of the bobbin. In practice, the actual magnetic attraction force may be somewhat less than this value for various reasons. For instance, the full surface area of the flange may not be in contact with the end wall of the bobbin; for one thing, the end wall of the bobbin case may include cut-outs such as shown in FIG. 1, thereby reducing the surface area in contact with the flange. Additionally, the flange may not lie perfectly flat against the end wall. Factors such as these, to the extent they can be predicted and quantified, can be taken into account when designing the flange so that the desired amount of magnetic force is achieved.

Variations on the illustrative bobbin described above are possible. For example, the flange outer diameter can be larger or smaller, depending on various factors such as the inner diameter of the bobbin case, the magnetic strength of the material of the flange, the desired amount of magnetic attraction force between the bobbin and the bobbin case end wall, and others. Generally, for bobbins used with bobbin cases having an inner diameter of 0.875 inch, it is preferred that the flange have an outer diameter of about 0.6 to 0.85 inch, and more preferably about 0.625 to 0.8 inch. It is also preferred that the flange have an outer diameter that is smaller than the inner diameter of the bobbin case by at least the difference between the outer diameter of the post 12 and the inner diameter of the core 122, whereby the outer periphery of the flange is substantially prevented from rubbing on the inner surface of the bobbin case. In order to account for possible eccentricity of the flange relative to the core, it is advisable to increase this difference between the flange outer diameter and the bobbin case inner diameter by the largest expected eccentricity of the flange. However, in many cases, the flange outer diameter can be made even smaller while still providing the desired amount of magnetic attraction force. Thus, in the illustrative example cited above, the 0.105 inch difference between the flange diameter of 0.770 and the bobbin case inner diameter of 0.875 inch is substantially more than is needed to prevent contact between the outer edge of the flange and the bobbin case inner surface.

It will be appreciated, therefore, that unlike prior sidewall bobbins in which the outer diameter of the flange is critical and the concentricity of the flange relative to the core must be carefully controlled to prevent interference with the bobbin case, the bobbin of the present invention is much more forgiving in terms of flange diameter and concentricity. The invention thus retains the benefits of the sidewall bobbin design relative to sideless bobbins (reduced tendency to wobble compared to sideless bobbins, reduced likelihood of the thread inadvertently looping beneath the bobbin around the bobbin case post and subsequently snagging and breaking, ease of proper orientation of the bobbin in the bobbin case), while eliminating the detrimental interference with the bobbin case that can easily occur with conventional sidewall bobbins.

The invention in preferred embodiments also enables a relatively simple manufacturing technique. Thus, where the flange 126 is formed of a flexible magnet sheet, the flange is easily formed by die-cutting the sheet. Multiple flanges can be die-cut simultaneously from a single sheet. The core 122 preferably is formed of a spirally wound paper tube. The flexible flange 126 preferably is attached to the core by an interference fit. More specifically, a central hole is cut in the flange in the die-cutting process, and the central hole diameter is less than the outer diameter of the core 122 by a suitable amount. The flange is pressed over the end of the core; preferably, the end of the core is then swaged slightly to increase its diameter so as to reduce the likelihood of the flange coming off. If desired, an adhesive can be applied between the outer surface of the core and the inner edge of the hole in the flange to augment the attachment of the flange. Alternatively, instead of an interference fit, the flange can be attached entirely by adhesive, such as a hot melt or the like. The flange can be attached to the core either before or after winding of the thread onto the core.

Figure 5:
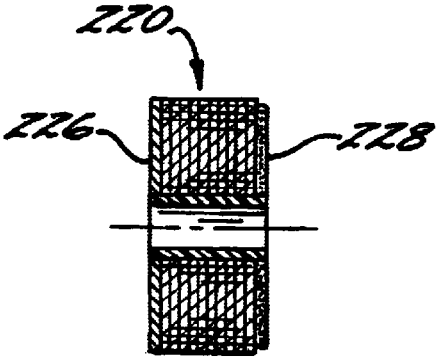
FIG. 5 is a cross-sectional view of a pre-wound bobbin in accordance with an alternative embodiment of the invention.

As previously noted, the invention is not limited to single-flange bobbins, but also extends to double-flange bobbins such as the bobbin 220 shown in FIG. 5. The bobbin 220 is generally similar to the previously described single-flange bobbin 120, except it includes a second flange 228 in addition to the magnetized flange 226. Preferably, the flange 228 is non-magnetized and is readily visually distinguishable from the magnetized flange 226 so that it is easy to determine which way to load the bobbin into a bobbin case. Advantageously, the flange 228 can be made of a flexible material such as paper, plastic, or the like.

Bobbins in accordance with the invention can be made in various bobbin styles and thread types and sizes. For any given bobbin style and thread type/size, the flange diameter, thickness, composition, and magnetic strength can be selected to provide the desired draw-off tension to enhance the sewing properties.

Many modifications and other embodiments of the invention will come to mind to one skilled in the art to which this invention pertains having the benefit of the teachings presented in the foregoing descriptions and the associated drawings. For example, the magnetized flange 126, 226 could have an outer periphery that is other than circular if desired. Although it is preferred that the core 122 be non-magnetized, alternatively the core could be magnetized in addition to the flange. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A pre-wound bobbin for removably mounting in a steel bobbin case formed as a generally cup-shaped housing having an end wall at one end thereof and being open at the other end thereof and having a post mounted on the end wall, the pre-wound bobbin comprising:

a hollow cylindrical core for fitting over the post of the bobbin case such that the core rotates freely relative to the post;

a continuous length of thread wound onto the core; and a flange comprising a flexible sheet magnet attached to one end of the core and extending radially outwardly therefrom, the flange exerting a magnetic attraction force on the end wall of the bobbin case when the bobbin is mounted therein with the flange in contact with the end wall, the flange being configured to provide sufficient contact area with the end wall of the bobbin case and having a magnetic strength of sufficient magnitude such that said magnetic attraction force exceeds the weight of the pre-wound bobbin yet allows the bobbin to be rotated on the post by pulling the thread tangentially away from the bobbin.

2. The pre-wound bobbin of claim 1, wherein the flexible sheet magnet has a thickness of about 0.010 to about 0.020 inch.

3. The pre-wound bobbin of claim 1, wherein the flange includes a non-magnetized layer forming the surface of the flange that faces the thread wound on the core.

4. The pre-wound bobbin of claim 1, wherein the flange has a circular outer periphery.

5. A pre-wound bobbin for removably mounting in a steel bobbin case formed as a generally cup-shaped housing having an end wall at one end thereof and being open at the other end thereof and having a post mounted on the end wall, the pre-wound bobbin comprising:

a hollow cylindrical core for fitting over the post of the bobbin case such that the core rotates freely relative to the post wherein the core is non-magnetized;

a continuous length of thread wound onto the core; and a flange attached to one end of the core and extending radially outwardly therefrom, the flange comprising a magnetized material that exerts a magnetic attraction force on the end wall of the bobbin case when the bobbin is mounted therein with the flange in contact with the end wall, the flange being configured to provide sufficient contact area with the end wall of the bobbin case and the magnetized material having a magnetic strength of sufficient magnitude such that said magnetic attraction force exceeds the weight of the pre-wound bobbin yet allows the bobbin to be rotated on the post by pulling the thread tangentially away from the bobbin.

6. The pre-wound bobbin of claim 5, wherein the core is non-metallic.

7. A pre-wound bobbin for removably mounting in a steel bobbin case formed as a generally cup-shaped housing having an end wall at one end thereof and being open at the other end thereof and having a post mounted on the end wall, the pre-wound bobbin comprising:

a hollow cylindrical core for fitting over the post of the bobbin case such that the core rotates freely relative to the post;

a continuous length of thread wound onto the core; and a flange attached to one end of the core and extending radially outwardly therefrom, the flange comprising a magnetized material that exerts a magnetic attraction force on the end wall of the bobbin case when the bobbin is mounted therein with the flange in contact with the end wall, the flange being configured to provide sufficient contact area with the end wall of the bobbin case and the magnetized material having a magnetic strength of sufficient magnitude such that said magnetic attraction force exceeds the weight of the pre-wound bobbin yet allows the bobbin to be rotated on the post by pulling the thread tangentially away from the bobbin;

wherein the bobbin comprises a single-flange bobbin.

8. The pre-wound bobbin of claim 7, wherein the magnetized material of the flange adheres flat against a bare, planar steel surface with a magnetic force of about 0.2 to 0.4 pounds per square inch of the magnetic material.

9. The pre-wound bobbin of claim 8, wherein the flange has a surface area of about 0.2 to 0.5 square inch.

10. The pre-wound bobbin of claim 7, wherein the thread has a coating of an adhesive substance such that the thread adheres to itself.

11. A pre-wound bobbin for removably mounting in a steel bobbin case formed as a generally cup-shaped housing having an end wall at one end thereof and being open at the other end thereof and having a post mounted on the end wall, the pre-wound bobbin comprising:

a hollow cylindrical non-magnetized core for fitting over the post of the bobbin case such that the core rotates freely relative to the post;

a continuous length of thread wound onto the core; and a magnetized flange attached to one end of the core and extending radially outwardly therefrom, the flange exerting a magnetic attraction force on the end wall of the bobbin case when the bobbin is mounted therein with the flange in contact with the end wall such that the flange provides a magnetic drag force resisting rotation of the bobbin.

12. The pre-wound bobbin of claim 11, wherein the flange comprises a flexible sheet magnet.

13. The pre-wound bobbin of claim 11, wherein the flange adheres against a bare, planar steel surface with a magnetic force of about 10 to 20 times the weight of the bobbin.

14. The pre-wound bobbin of claim 11, wherein the core is non-metallic.

15. The pre-wound bobbin of claim 11, wherein the bobbin comprises a single-flange bobbin.

16. The pre-wound bobbin of claim 11, wherein the flange is formed of a magnetized material that adheres flat against a bare, planar steel surface with a magnetic force of about 0.2 to 0.4 pounds per square inch of the magnetized material.

17. The pre-wound bobbin of claim 11, wherein the flange has a circular outer periphery defining an outer diameter of the flange, and the thread is wound to form a substantially cylindrical roll having an initial outer diameter prior to usage of any of the thread, and wherein the outer diameter of the flange does not exceed the initial outer diameter of the roll of thread.

18. The pre-wound bobbin of claim 17, wherein the outer diameter of the flange is less than the initial diameter of the roll of thread.

19. The pre-wound bobbin of claim 11, further comprising a second non-magnetized flange attached to an opposite end of the core from the end having the magnetized flange.

20. The pre-wound bobbin of claim 19, wherein the magnetized and non-magnetized flanges are visually distinct from each other such that it is readily determinable in which direction the bobbin should be loaded into the bobbin case.

21. The pre-wound bobbin of claim 20, wherein both flanges are relatively flexible and the core is relatively rigid.

22. A single-flange pre-wound bobbin for removably mounting in a steel bobbin case formed as a generally cup-shaped housing having an end wall at one end thereof and being open at the other end thereof and having a post mounted on the end wall, the pre-wound bobbin comprising:

a hollow cylindrical non-magnetized core for fitting over the post of the bobbin case such that the core rotates freely relative to the post;

a continuous length of thread wound onto the core; and a flange formed from a flexible sheet magnet attached to one end of the core and extending radially outwardly therefrom, the flange exerting a magnetic attraction force on the end wall of the bobbin case when the bobbin is mounted therein with the flange in contact with the end wall such that the flange provides a magnetic drag force resisting rotation of the bobbin.

23. The single-flange pre-wound bobbin of claim 22, wherein the flange has a central aperture that receives the end of the core and the flange is attached to the core by an interference fit therebetween.

24. A bobbin assembly for sewing, comprising:

a steel bobbin case formed as a generally cup-shaped housing having a tubular cylindrical portion and an end wall closing one end of the tubular cylindrical portion, the other end of the tubular cylindrical portion being open, and the bobbin case having a post mounted on the end wall and extending toward the open end of the tubular cylindrical portion; and a pre-wound bobbin mounted in the bobbin case, the bobbin comprising a hollow cylindrical nonmagnetized core that fits loosely over the post such that the core rotates freely relative to the post, a continuous length of thread wound onto the core, and a magnetized flange attached to one end of the core and extending radially outwardly therefrom, the flange contacting the end wall of the bobbin case and exerting a magnetic attraction force on the end wall such that the flange provides a magnetic drag force resisting rotation of the bobbin, wherein the flange is sized to have a surface area in contact with the end wall and the flange is formed of a magnetized material selected to have a magnetic strength such that the magnetic attraction force exceeds the weight of the pre-wound bobbin so as to retain the bobbin in the bobbin case.

25. The bobbin assembly of claim 24, wherein the magnetic attraction force is about 10 to 20 times the weight of the pre-wound bobbin.

26. The bobbin assembly of claim 24, wherein the magnetized flange has an outer diameter that is smaller than a diameter of an inner surface of the tubular portion of the bobbin case by an amount that equals or exceeds a difference between an outer diameter of the post and an inner diameter of the core, whereby the flange is substantially prevented from rubbing on the inner surface of the tubular portion of the bobbin case.

* * * * *